United States Patent [19]

Disosway, III et al.

[11] 4,045,062

[45] Aug. 30, 1977

[54] ELECTRIC CRANKING MOTOR AUTOMATIC DISCONNECT AND LOCKOUT CIRCUIT

[75] Inventors: Mark D. Disosway, III, Anderson; Leonard J. Sheldrake, Noblesville, both of Ind.

[73] Assignee: General Motors Corporation, Detroit, Mich.

[21] Appl. No.: 641,444

[22] Filed: Dec. 17, 1975

[51] Int. Cl.[2] ..... F02N 11/08

[52] U.S. Cl. ..... 290/38 R; 290/37 A

[58] Field of Search ..... 290/37 A, 37 R, 38, 290/DIG. 4

[56] References Cited

U.S. PATENT DOCUMENTS

| | | | |
|---|---|---|---|
| 3,628,041 | 12/1971 | Cummins et al. | 290/37 R |
| 3,857,043 | 12/1974 | Habasch | 290/37 |

*Primary Examiner*—Robert K. Schaefer
*Assistant Examiner*—Eugene S. Indyk
*Attorney, Agent, or Firm*—Richard G. Stahr

[57] ABSTRACT

The output signal produced by a two input electrical circuit element of the type which produces opposite polarity output signals upon the application of the same polarity input signal to respective ones of the input terminals is applied to the control electrode of a switching transistor which, when conductive, is effective to complete the energizing circuit of an internal combustion engine cranking motor. An electrical bias signal of a selected polarity is applied to the one of the input terminals of this circuit element which will result in an output signal of the polarity which will trigger the switching transistor conductive through the current carrying electrodes thereof. An engine speed electrical signal of the selected polarity and of a magnitude directly proportional to the speed of an associated cranked internal combustion engine is applied to the other input terminal of this circuit element whereby when the engine speed has reached and exceeds a predetermined magnitude, the output potential signal of the circuit element is of a polarity which will extinguish the switching transistor to interrupt the cranking motor energizing circuit.

2 Claims, 1 Drawing Figure

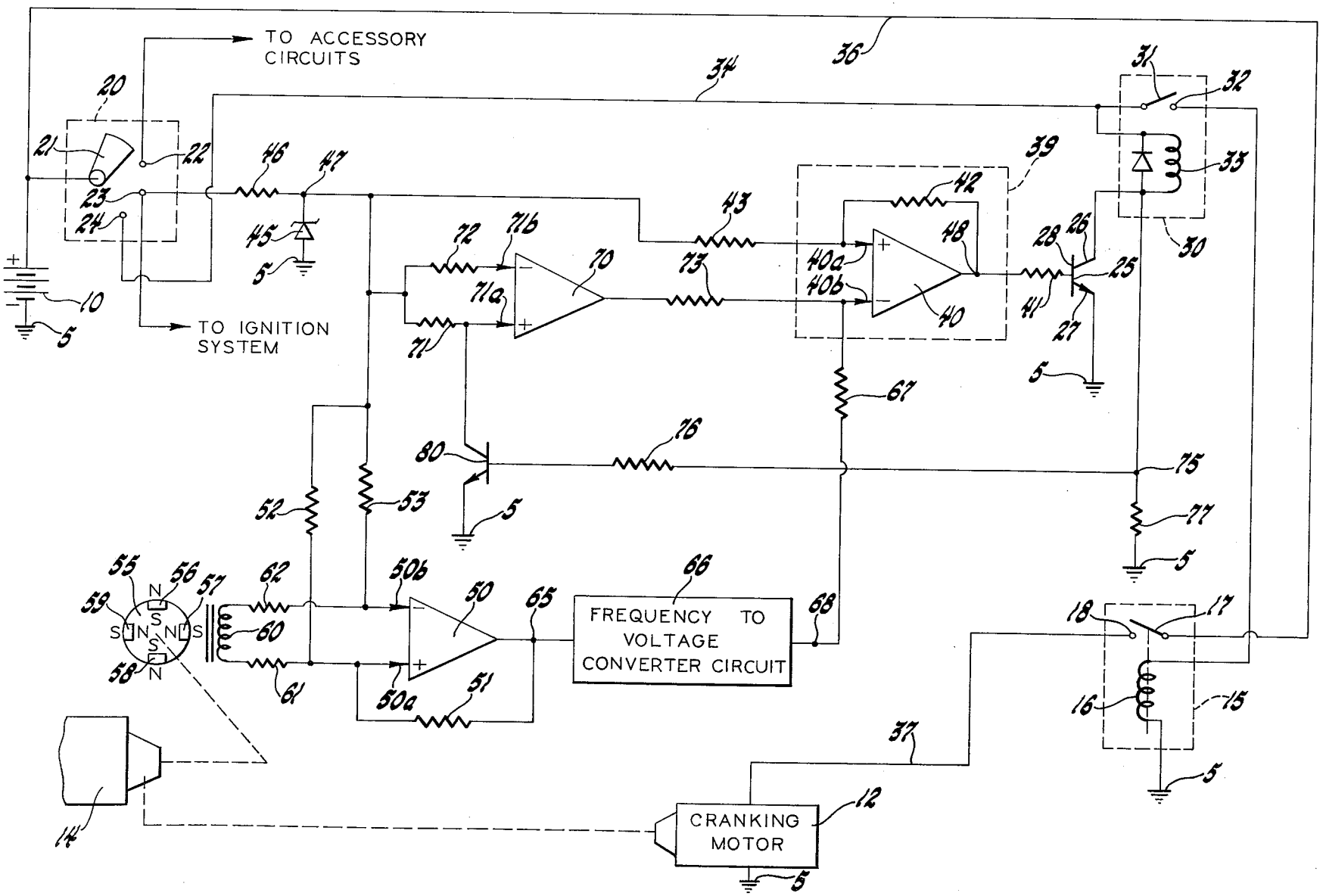
FREQUENCY TO VOLTAGE CONVERTER CIRCUIT
CRANKING MOTOR
TO ACCESSORY CIRCUITS
TO IGNITION SYSTEM

ELECTRIC CRANKING MOTOR AUTOMATIC DISCONNECT AND LOCKOUT CIRCUIT

This invention is directed to an electric cranking motor automatic disconnect and lockout circuit and, more specifically, to a circuit of this type which is responsive to an electrical signal of a selected polarity and of a direct current potential magnitude directly proportional to engine speed to automatically interrupt the cranking motor energizing circuit upon engine "start" and to prevent the reenergization thereof while the engine is in the running mode.

Electric cranking motors are frequently employed to provide the initial impetus to start internal combination engines which are used as a power source for a variety of applications. To prevent serious damage to the engine, the cranking motor and the cranking motor engagement mechanism, it is necessary that the cranking motor be deenergized upon engine "start" and that the cranking motor energizing circuit be prevented from being energized while the engine is in the running mode. Therefore, a circuit which will automatically deenergize the cranking motor energizing circuit upon engine "start" and which will prevent the reenergization of the cranking motor energizing circuit while the engine is in the running mode is desirable.

It is, therefore, an object of this invention to provide an improved electric cranking motor automatic disconnect and lockout circuit.

It is another object of this invention to provide an improved electric cranking motor automatic disconnect and lockout circuit which is responsive to the potential magnitude of a cranked engine speed electrical signal of a selected polarity and of a magnitude directly proportional to the speed of the associated cranked internal combustion engine to interrupt the cranking motor energizing circuit upon engine "start" and to prevent the reenergization thereof while the engine is in the running mode.

It is an additional object of this invention to provide an improved electric cranking motor automatic disconnect and lockout circuit which prevents the reenergization of an internal combustion engine electrical cranking motor until the speed of the cranked engine has reduced to a preselected low value.

In accordance with this invention, an electric cranking motor automatic disconnect and lockout circuit is provided wherein the energizing circuit of the cranking motor is established and interrupted by a switching transistor which is conductive through the current carrying electrodes thereof during the engine "crank" operation and is extinguished in response to an engine speed electrical signal of a selected polarity and of a magnitude directly proportional to the speed of an associated cranked internal combustion engine.

For a better understanding of the present invention, together with additional objects, advantages and features thereof, reference is made to the following description and accompanying single FIGURE drawing which sets forth the electric cranking motor automatic disconnect and lockout circuit of this invention partially in schematic and partially in block form.

As point of reference or ground potential is the same point electrically throughout the system, it has been illustrated in the drawing by the accepted schematic symbol and referenced by the numeral 5.

Referring to the drawing, the electric cranking motor automatic disconnect and lockout circuit of this invention is set forth in combination with a source of direct current potential, which may be a conventional storage battery 10, an electric cranking motor 12 connected thereacross through the normally open contacts of a cranking motor solenoid operated switch 15 having an operating coil 16 and two normally open contacts, movable contact 17 and stationary contact 18, and an internal combustion engine 14 cranked by cranking motor 12.

As conventional electric cranking motors and internal combustion engines are well known in the art and, per se, form no part of this invention, in the interest of reducing drawing complexity, each has been represented in the FIGURE in block form. As is well known in the art, cranking motor 12 may be driveably engaged with the ring gear of engine 14 in a conventional manner.

The cranking motor solenoid operated switch 15, hereinafter referred to as a solenoid operated switch, may be any of the several cranking motor solenoids well known in the art.

The electrical switch 20 may be a conventional automotive type ignition switch having an open or "off" position, in which position it is indicated in the drawing, a "run" position at which movable contact 21 is closed to stationary contacts 22 and 23 and a "crank" position at which movable contact 21 is closed to stationary contacts 23 and 24. As is well known in the art, ignition switches of this type are spring biased to automatically return from the "crank" position to the "run" position wherein movable contact 21 is closed to stationary contact 22 and 23 when the torque applied to the ignition key is released.

The operating coil 16 of solenoid operated switch 15 is connected across the source of direct current potential 10 through the normally open contacts, movable contact 31 and stationary contact 32, of an electrical relay 30, having an operating coil 33, through a circuit which may be traced from the position polarity terminal of battery 10, through movable contact 21 and stationary contact 24 of electric switch 20 when movable contact 21 is in the "crank" position, lead 34, the movable-stationary contact pair 31–32 of electric relay 30, lead 35, operating coil 16 of solenoid operated switch 15 and point of reference or ground potential 5 to the negative polarity terminal of battery 10.

Operating coil 33 of electric relay 30 is connected across the source of direct current potential 10 through the current carrying electrodes, collector electrode 26 and emitter electrode 27, of NPN transistor 25 through a circuit which may be traced from the positive polarity terminal of battery 10, through movable contact 21 and stationary contact 24 of electrical switch 20 when movable contact 21 is in the "crank" position, lead 34, operating coil 33 of electric relay 30, the collector-emitter electrode of NPN transistor 25 and point of reference or ground potential 5 to the negative polarity terminal of battery 10.

Although the electrical switching device is indicated in the drawing to be a type NPN transistor, it is to be specifically understood that any electrical switching device of the type operable to an electrical circuit closed condition and to an electrical circuit open position in response to respective applied electrical signals of a first polarity and of another polarity may be employed.

While movable contact 21 of electrical switch 20 is in the "crank" position, at which it is in electrical contact with stationary contacts 23 and 24, with NPN transistor 25 conductive through the collector-emitter electrodes, operating coil 33 of electric relay 30 is energized to operate movable contact 31 into electrical circuit closed engagement with stationary contact 32 to complete the energizing circuit for operating coil 16 of solenoid operated switch 15. Upon the energizing of operating coil 16, movable contact 17 is operated into electrical circuit closed engagement with stationary contact 18 to complete the energizing circuit for cranking motor 12 which may be traced from the positive polarity terminal of battery 10, through lead 36, the closed movable-stationary contact pair 17–18 of solenoid operated switch 15, lead 37, cranking motor 12 and point of reference or ground potential 5 to the negative polarity terminal of battery 10. The electrical switching device NPN transistor 25, is, therefore, effective to establish and interrupt the energizing circuit for cranking motor 12.

The output signal produced by a driver circuit 39 is applied to the base electrode 28 of NPN transistor 25 through current limiting resistor 41. Driver circuit 39 may be made up of a circuit element 40 of the type having two input circuit terminals **40*a* and 40*b* which is responsive to electrical signals of a selected one polarity supplied to the non-inverting input terminal 40*a* for producing an output potential signal of the same polarity and to electrical signals of the same selected polarity applied to the inverting input terminal 40*b* for producing an output signal of the opposite polarity. In the preferred embodiment, one fourth of a commercially available quad amplifier integrated circuit package with a feedback resistor 42 connected between the output terminal and the non-inverting input terminal 40*a*** was employed. One example of a commercially available package suitable for this application is marketed by National Semiconductor Corporation under the designation LM 3900 quad amplifier. These devices produce a positive polarity output signal while more current is entering the non-inverting input terminal than is entering the inverting input terminal and a negative polarity output signal when more current is entering the inverting input terminal than is entering the non-inverting input terminal. Connected as shown in the Figure, this circuit functions as a trigger circuit.

In the preferred embodiment, the operating potential for the circuit of this invention is limited to a value compatible with the circuit elements, for example 8 volts, by a zener diode 45 and a current limiting resistor 46. While movable contact 21 of electrical switch 20 is an electrical circuit closed engagement with stationary contact 23, when in the "crank" or "run" positions, the potential appearing across junction 47 and point of reference or ground potential 5 supplies current to the non-inverting input terminal **40*a* of driver circuit 39 through current limiting resistor 43. Assuming for the moment that the current entering the inverting input terminal 40*b* is less than that supplied to non-inverting input terminal 40*a*, driver circuit 40 produces an output signal which is of a positive polarity upon output terminal 48 with respect to point of reference or ground potential 5**.

To produce an engine speed direct current electrical signal of a selected polarity and of a magnitude directly proportional to the speed of the associated cranked internal combustion engine, another section 50 of the previously described LM 3900 quad amplifier package was employed as a squaring amplifier circuit with hysteresis provided by feedback resistor 51. The potential appearing across junction 47 and point of reference or ground potential 5 is applied across both the inverting input terminal **50*a* and to the non-inverting input terminal 50*b* through respective resistors 52 and 53 of an equal ohmic value. To provide an input signal of a frequency proportional to engine speed, a magnetic pickup circuit of the type having a rotatable member 55 having a plurality of permanent magnets 56, 57, 58 and 59 arranged about the periphery thereof in such a manner that adjacent poles are of the opposite polarity may be employed. Rotatable member 55 is rotated in timed relationship with engine 14 by a selected one of the rotating elements of engine 14 in a manner well known in the art. The magnets about the periphery of rotatable member 55 are in magnetic flux linking arrangement with a pickup coil 60, the opposite terminal ends of which are connected to the non-inverting input terminal 50*a* and the inverting input terminal 50*b* of element 50 through respective current limiting resistors 61 and 62. As rotatable member 55, therefore, is rotated by engine 14, the output signal appearing upon output terminal 65 is a square wave alternating between ground potential and the positive polarity potential appearing across junction 47 and point of reference or ground potential 5 and of a frequency proportional to engine speed. This signal is applied to the input terminal of a conventional frequency to voltage converter circuit 66 which, since it may be any of the several frequency to voltage converter circuits well known in the art, is indicated in the drawing in block form. Frequency to voltage converter circuit 66 produces a direct current electrical output signal of a positive polarity and of a potential magnitude proportional to engine speed which is applied through current limiting resistor 67 to the inverting input terminal 40*b* of driver circuit 39**.

Upon the initial operation of movable contact 21 of electrical switch 20 to the "crank" position at which it is in electrical circuit engagement with stationary contacts 23 and 24, the output signal of driver circuit 39 is of a positive polarity upon output terminal 48 with respect to point of reference or ground potential 5. As this is the proper polarity potential signal to product base-emitter drive current through an NPN transistor, NPN transistor 25 is triggered conductive through the collector-emitter electrodes to complete the energizing circuit previously described for operating coil 33 of electrical relay 30. Upon the energization of operating coil 33, movable contact 31 is operated into electrical circuit closed engagement with stationary contact 32 to complete the previously described energizing circuit for operating coil 16 of solenoid operated switch 15. Upon the energization of operating coil 16, movable contact 17 is operated into electrical circuit closed engagement with stationary contact 18 to complete the energizing circuit previously described for cranking motor 12. When cranking motor 12 has started engine 14, the potential appearing across output terminal 68 of frequency to voltage converter circuit 66 increases in magnitude in a positive direction until it is of a sufficient magnitude to supply more current to inverting input terminal **40*b* of driver circuit 39 than is supplied to non-inverting input terminal 40*a*. At this time, the output signal of driver circuit 39 appearing across output terminal 48 and point of reference or ground potential 5 drops substantially instantly to ground potential because of the feedback action of feedback resistor 42. With a ground potential signal present upon base electrode 28, NPN transistor 25 extinguishes to interrupt the energizing circuit of operating coil 33 of electrical relay 30. Upon the deenergization of operating coil 33, movable contact 31 is spring operated out of electrical circuit engagement with stationary contact 32 to interrupt the energizing circuit for operating coil 16 of solenoid operated switch 15. Upon the interruption of the energizing circuit for operating coil 16, movable contact 17 is spring operated out of the electrical circuit engagement from stationary contact 18 to interrupt the energizing circuit for cranking motor 12.**

While engine 14 is running, the output engine speed direct current electrical signal produced by frequency to voltage converter circuit 66 and appearing across output terminal 68 and point of reference or ground potential 5 is of a sufficient magnitude to supply a greater amount of current to inverting input terminal **40*b* of driver circuit 39, a condition which maintains NPN transistor 25 not conductive. Consequently, the cranking motor 12 energizing circuit is locked out regardless of where movable contact 21 of electrical switch 20 is operated until the speed of engine 14** has reduced to a predetermined low value, for example 50 RPM.

To prevent the cranking motor 12 energizing circuit from being jogged, that is, should switch 21 be operated to the "crank" position, released and then immediately operated back to the "crank" position, a jogging of the cranking motor would result. To prevent this, an anti-jogging circuit 70 is provided which is comprised of another section of the previously described LM 3900 quad amplifier package. The potential appearing across junction 47 and point of reference or ground potential 5 is applied to the non-inverting input terminal **71*a* and to the inverting input terminal 71*b* through respective resistors 71 and 72. The ohmic value of each of resistors 71 and 72 is so proportioned that, normally more current would be supplied to the non-inverting input terminal 70*a* than would be supplied to the inverting input terminal 71*b*. That is, the ohmic value of resistor 71 would be much less than the ohmic value of resistor 72. The output signal of the anti-jog circuit 70 is applied through current limiting resistor 73 to the inverting input terminal 40*b* of driver circuit 39. While NPN transistor 25 is energized, the potential drop thereacross which appears across junction 75 and point of reference or ground potential 5 is of sufficient magnitude to supply base drive current to NPN transistor 80 through current limiting resistor 76. This base drive current triggers NPN transistor 80 conductive through the collector-emitter electrode which drains current from non-inverting input terminal 71*a* of anti-jog circuit 70 to point of reference or ground potential 5. While transistor 80 is conductive through the collector-emitter electrodes, a greater amount of current is supplied to inverting input terminal 71*b* of anti-jog circuit 70. Consequently, the output signal thereof is of ground potential which is of no effect upon the remainder of the circuit. Should movable contact 21 of electrical switch 20 be released out of the "crank" position before engine 14 has started, the potential across lead 34 and point of reference or ground potential 5 is substantially zero, consequently, NPN transistor 25 extinguishes. With transistor 25 extinguished, resistor 77 connects the base electrode of NPN transistor 80 to point of reference or ground potential 5, a condition which extinguishes NPN transistor 80. When NPN transistor 80 has extinguished, the current supplied to non-inverting input terminal 71*a* of anti-jog circuit 70 is greater than that supplied to inverting input terminal 71*b*, consequently, the output signal of anti-jog circuit 70 is of a positive polarity and is applied to the inverting input terminal 40*b* of driver circuit 39. This signal, combined with the engine speed signal, supplies more current to inverting input terminal 40*b* than is supplied to the non-inverting input terminal 40*a*, consequently, a substantially ground potential is present upon output terminal 48 which maintains transistor 25 not conductive. Therefore, even should the movable contact 21 of the electrical switch 20 be operated to the "crank" position, the energizing circuit for cranking motor 12 would not be established until the speed of crank engine 14 has reduced to the predetermined low value, for example 50 RPM. This low value of engine speed may be predetermined by selecting the ohmic value of feedback resistor 42 as the ohmic value of resistor 42 determines the hysteresis of driver circuit 39.**

Although a preferred embodiment of the present invention has been shown and described, it will be obvious to those skilled in the art that various modifications and substitutions may be made without departing from the spirit of the invention which is to be limited only within the scope of the appended claims.

What is claim is:

1. An electric cranking motor automatic disconnect and lockout circuit of the type effective to automatically interrupt and lock out the electrically energizable energizing circuit for an internal combustion engine electric cranking motor when the speed of the cranked engine reaches and exceeds a predetermined value comprising in combination with an electric switch having "Off", "Run", and "Crank" positions:

an electrical switching device effective to establish and interrupt the internal combustion engine cranking motor electrically energizable energizing circuit and being of the type operable to an electrical circuit closed condition and to an electrical circuit open condition in response to respective applied electrical signals of a first polarity and of another polarity;

first circuit means having first and second input circuit means and being of the type which produces an output signal of a first polarity in response to a said first input circuit means input electrical signal level of a magnitude greater than the said second input circuit means input electrical signal level and which produces an output signal of a second polarity in response to a said second input circuit means input electrical signal level of a magnitude greater than the said first input circuit means input electrical signal level;

means for applying an electrical reference signal of a substantially constant magnitude and of a selected polarity to one of said first and second input circuit means of said first circuit means while said electric switch is in both the said "Run" and "Crank" positions;

means for producing an electrical engine speed signal of the same said selected polarity as said reference signal and of a magnitude directly proportional to the speed of an associated cranked internal combustion engine;

means for applying said engine speed signal to the other one of said first and second input circuit means of said first circuit means whereby said first circuit means produce a combination automatic disconnect and lockout electrical output signal of the polarity to which said electrical switching device is responsive for operation to the electrical circuit open condition when the level of said engine speed signal reaches and exceeds that of said reference signal;

means for applying said output signals of said first circuit means to said electrical switching device whereby said electrical switching device is operated to the electrical circuit open condition when the speed of said cranked engine reaches and exceeds said predetermined value; and second circuit means for producing an electrical auxiliary lockout signal of the same polarity as said reference and engine speed signals in response to the operation of said second electrical switching device to the electrical circuit open condition and for applying said auxiliary lockout signal to the same out of said first and second input circuit means of said first circuit means as is said engine speed signal.

2. An electric cranking motor automatic disconnect and lockout circuit of the type effective to automatically interrupt and lock out the electrically energizable energizing circuit for an internal combustion engine electric cranking motor when the speed of the cranked engine reaches and exceeds a predetermined value comprising in combination with an electric switch having "Off", "Run", and "Crank" positions:

an electrical switching device effective to establish and interrupt the internal combustion engine cranking motor electrically energizable energizing circuit and being of the type operable to an electrical circuit closed condition and to an electrical circuit open condition in response to respective applied electrical signals of a first polarity and of another polarity;

first circuit means having first and second input circuit means and being of the type which produces an output signal of a first polarity in response to a said first input circuit means input electrical signal level of a magnitude greater than the said second input circuit means input electrical signal level and which produces an output signal of a second polarity in response to a said second input circuit means input electrical signal level of a magnitude greater than the said first input circuit means input electrical signal level;

means for applying an electrical reference signal of a substantially constant magnitude and of a selected polarity to one of said first and second input circuit means of said first circuit means while said electric switch is in both the said "Run" and "Crank" positions;

means for producing an electrical engine speed signal of the same said selected polarity as said reference signal and of a magnitude directly proportional to the speed of an associated cranked internal combustion engine while said engine is in both the "Crank" and "Run" modes;

means for applying said engine speed signal to the other one of said first and second input circuit means of said first circuit means whereby said first circuit means produces a combination automatic disconnect and lockout electrical output signal of the polarity to which said electrical switching device is responsive for operation to the electrical circuit open condition when the level of said engine speed signal reaches and exceeds that of said reference signal;

means for applying said output signals of said first circuit means to said electrical switching device whereby said electrical switching device is operated to the electrical circuit open condition when the speed of said cranked engine reaches and exceeds said predetermined value; and second circuit means for producing an electrical auxiliary lockout signal of the same polarity as said reference and engine speed signals in response to the operation of said second electrical switching device to the electrical circuit open condition and for applying said auxiliary lockout signal to the same one of said first and second input circuit means of said first circuit means as is said engine speed signal.

* * * * *

UNITED STATES PATENT AND TRADEMARK OFFICE

CERTIFICATE OF CORRECTION

PATENT NO. : 4,045,062

DATED : August 30, 1977

INVENTOR(S) : Mark D. Disoway, III et al

It is certified that error appears in the above-identified patent and that said Letters Patent are hereby corrected as shown below:

Column 1, line 14, "combination" should read -- combustion --.
Column 4, line 42, "product" should read -- produce --.
Column 7, line 18, "out" should read -- one --.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*